US006177369B1

(12) United States Patent
Kwok

(10) Patent No.: US 6,177,369 B1
(45) Date of Patent: Jan. 23, 2001

(54) COMPRESSED BATT HAVING REDUCED FALSE LOFT AND REDUCED FALSE SUPPORT

(75) Inventor: Wo Kong Kwok, Hockessin, DE (US)

(73) Assignee: E. I. du Pont de Nemours and Company, Wilmington, DE (US)

( * ) Notice: Under 35 U.S.C. 154(b), the term of this patent shall be extended for 0 days.

(21) Appl. No.: 09/283,072

(22) Filed: Mar. 31, 1999

(51) Int. Cl.[7] ..... D04H 1/00; D04H 13/00

(52) U.S. Cl. ..... 442/327; 442/361; 442/364; 156/244.27; 264/257

(58) Field of Search ..... 442/327, 361, 442/364; 156/244.27; 264/257

(56) References Cited

U.S. PATENT DOCUMENTS

| | | | |
|---|---|---|---|
| 4,668,562 | 5/1987 | Street | 428/218 |
| 5,079,074 | 1/1992 | Steagall et al. | 428/218 |
| 5,532,050 | 7/1996 | Brooks | 428/220 |
| 5,558,924 | 9/1996 | Chien et al. | 428/181 |
| 5,702,801 | 12/1997 | Chien | 428/181 |

FOREIGN PATENT DOCUMENTS

| | | |
|---|---|---|
| 296 16 418 U1 | 1/1997 | (DE) . |
| 0 558 205 | 10/1993 | (EP) . |

*Primary Examiner*—Newton Edwards

(57) ABSTRACT

A batt, which may be used for a mattress, a seat cushion or a ground pad for a sleeping bag, is compressed so that it has reduced false loft and reduced false support, and is therefore more durable for consumer use. The batt is compressed so that, when subjected to use for an average life cycle (usually six years), it has a thickness reduction of less than 15% and a reduction of load-at-half-height of less than 40%.

7 Claims, 5 Drawing Sheets

COMPRESSED BATT HAVING REDUCED FALSE LOFT AND REDUCED FALSE SUPPORT

FIELD OF THE INVENTION

The present invention relates to a batt that is compressed so that it has reduced false loft and reduced false support and is therefore more durable for consumer use.

BACKGROUND OF THE INVENTION

Vertical folding technology (VFT) batts are made by a process as described in U.S. Pat. No. 5,558,924 to Chien et al. Such batts can be used for mattresses, seat cushions or ground pads for sleeping bags, etc., where support and comfort are key required attributes. While these VFT batts provide good support and resiliency initially after being manufactured, they may have false loft and false support. Thus, a batt having what appears to be acceptable loft and support when new may lose a significant portion of its loft or support after only a short period of use. After repeated use, such batts tend to sag and to develop body impressions. These are objectionable problems which are the source of complaints and returns from customers.

Therefore, there exists a need to remove false loft and false support in a batt before it is subjected to repeated use.

SUMMARY OF THE INVENTION

The present invention reduces the problems associated with the prior art by compressing a batt before it is subjected to repeated use to remove as much false loft and false support as possible. Such a batt can be used, for example, in a mattress, a seat cushion or a ground pad for a sleeping bag.

According to the present invention, the batt is compressed so that it has an acceptable reduction in thickness and an acceptable load-at-half-height when subjected to use for an average life cycle. In particular, the batt has a thickness reduction of less than 15% and a reduction of load-at-half-height of less than 40%.

DETAILED DESCRIPTION OF THE PREFERRED EMBODIMENTS

In accordance with the present invention, there is provided a process for making a compressed batt. The batt is made as known in the art of vertical folding technology. Specifically, the batt is made by blending base or conjugate fibers with binder fibers, where the base and the binder fibers are weighed to a specified ratio. The base or conjugate fibers may comprise any type of synthetic fiber, such as, by way of example, but not limited to, polyester staple fiber, nylon, etc., or any natural fiber, such as, for example, cotton. This blend is then fed to a bale opener, which separates the bundle fibers and further mixes the blend of the base fibers and binder fibers. In a continuous process, this mixture is air conveyed through a series of pipes and fed to a fine opener, which once again provides more opening and mixing of fibers. This mixture is then fed to a hopper by air conveying through pipes. The well mixed fibers are then fed to a carding machine. Two fiber webs are produced simultaneously from this card by two doffers. These two webs are fed continuously to a folding unit, which has a forming chamber. The webs are laid and folded horizontally in a continuous process inside the chamber. These layers of horizontally laid webs are re-oriented to the vertical direction by a series of conveyors. This series of conveyors hold the vertically folded batt in place and continuously feed the batt to an oven. The binder fibers in the batt are activated by heat and bond to the base fibers to provide support and stability for the batt. The bonded batt is then cooled at the exit of the oven.

Figure 1:
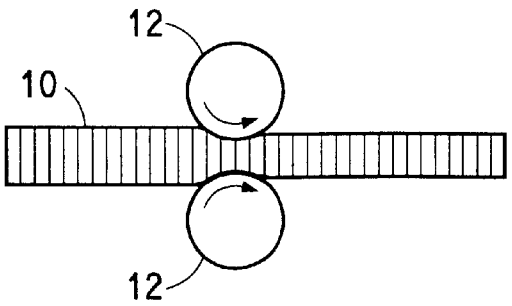
FIG. 1 is a schematic, cross-sectional view of a single set of compression rolls for compressing a batt according to one embodiment of the present invention.
Figure 2:
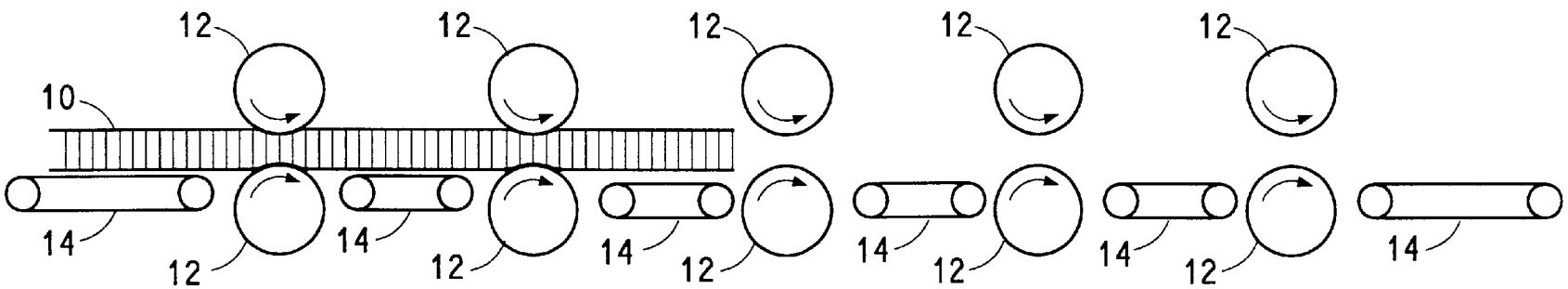
FIG. 2 is a schematic, cross-sectional view of multiple sets of compression rolls for compressing a batt according to another embodiment of the present invention.

The process of the present invention further comprises the step of compressing the batt with a compression device. A batt according to the present invention is shown in FIGS. 1, 2, 3 and 4 generally at 10. In accordance with the first embodiment of the present invention, which is illustrated with respect to FIG. 1, the batt is compressed by a cold calendering method. With this method, the batt is fed through a clearance between a pair of rolls, each roll being shown at 12 in FIG. 1. The clearance between the rolls is adjusted to less than half of the thickness of the batt. Alternatively, according to a second embodiment of the present invention, as illustrated in FIG. 2, the compression device comprises a plurality of pairs of rolls 12, and the batt is fed sequentially through each pair of rolls, one after the next as illustrated in FIG. 2. A conveyor 14 as shown in FIG. 2 moves the batt along between the pairs of rolls. In both the first and second embodiments, the batt is compressed at least five times. In addition, in the second embodiment, as in the first, the clearance between the rolls is adjusted to less than half of the thickness of the batt. Alternatively, instead of using a pair or a plurality of pairs of rolls to compress the batt, a hydraulic press (not shown), or any other mechanical compression device may be used. When a hydraulic press is used, the batt is compressed at least five times, and is compressed to about less than half of its original height. When other mechanical compression devices are used which flex the batt, the batt is compressed for enough cycles so that false loft is virtually eliminated.

Figure 3:
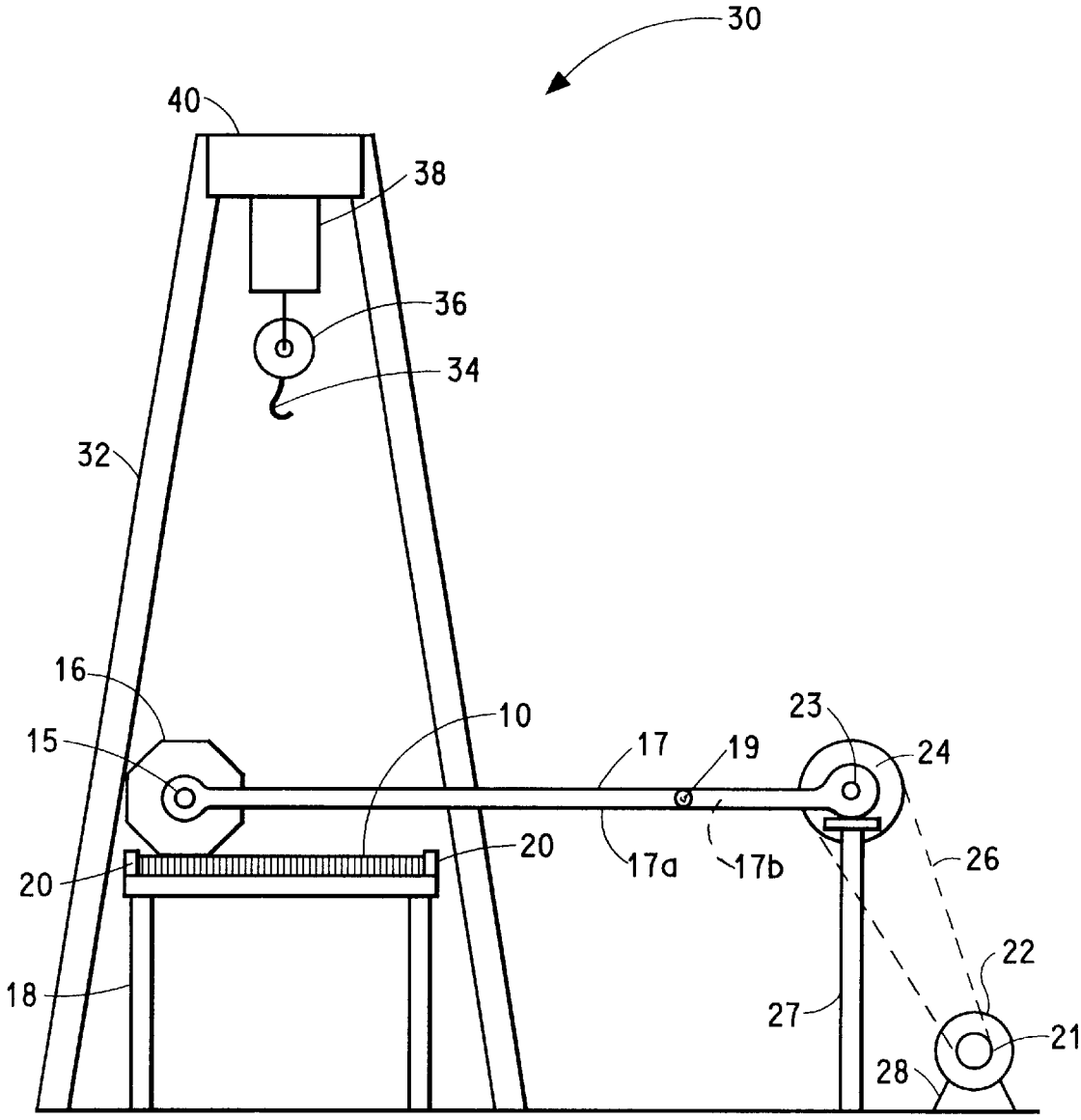
FIG. 3 is an end view of another device for compressing a batt according to a further embodiment of the present invention, in which the device is completely extended along the surface of the batt.
Figure 3A:
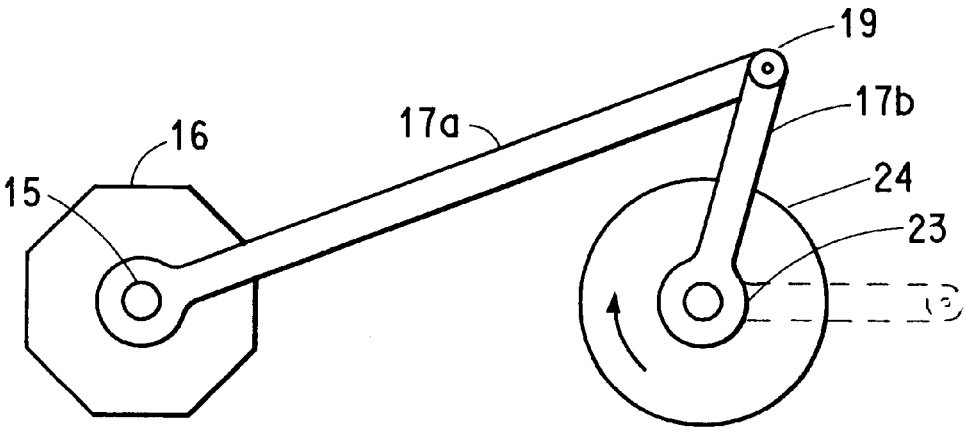
FIG. 3A is partial view of the device in FIG. 3, in which the device is partially extended along the surface of the batt.

According to a third embodiment of the present invention, which is illustrated with respect to FIGS. 3 and 3A, the batt is compressed with a compression device known as a Rolator, shown generally at 30. A Rolator is a proprietary device which may be used to compress batts similar to the pair of calender rolls as described above with respect to the first embodiment, except the Rolator applies compression under a constant weight instead of applying compression by a pair of rolls spaced by a constant clearance. According to this third embodiment, the batt is compressed for at least twenty full cycles, where a cycle is defined as the backward and forward movement of the arms. The octagonal roll used with the present invention weighs about 320 lbs (145 kg).

However, it should be noted that a heavier roll could be used, which would reduce the number of compression cycles, or conversely, a lighter roll could be used, which would increase the number of compression cycles.

Figure 3B:
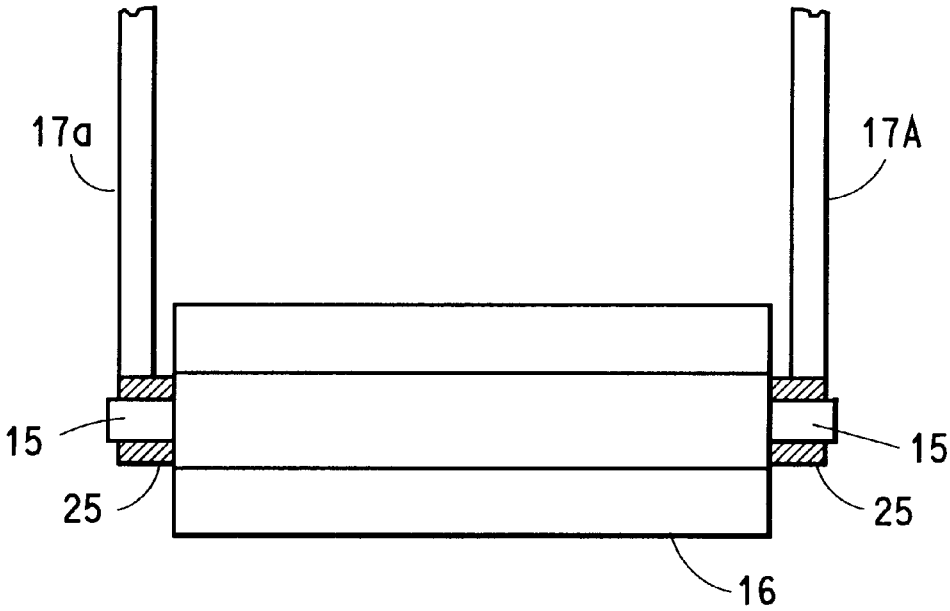
FIG. 3B is a top view of the octagonal roll of the device of FIG. 3.

The Rolator is shown with the octagonal roll fully extended to one end of the surface of the batt in FIG. 3, and partially extended along the surface of the batt in FIG. 3A. As shown in FIGS. 3 and 3A, Rolator 30 comprises an octagonal roll 16, which is rotatable about a fixed center shaft 15. The Rolator as shown in FIG. 3 also comprises a support 18 for the batt, and a pair of restraints 20, one at each end of the batt, so that the batt will not move back and forth when the roll is moved back and forth thereon. The Rolator of the third embodiment further comprises a sprocket assembly, including a driver sprocket, or motor, 22, which rotates about a center pin 21 and a driven sprocket 24, which is driven about a center shaft 23. The driver sprocket and the driven sprocket are connected by a chain 26. Driver sprocket 22 is supported by a base 28 as shown in FIG. 3, and driven sprocket 24 is supported by a beam 27. Driver sprocket 22 is operated by a motor switch, not shown. Driven sprocket 24 is connected to octagonal roll 16 by an arm 17. As can be seen from FIGS. 3 and 3A, arm 17 comprises an arm piece 17*a* and an arm piece 17*b*, which are connected by a link 19. Arm piece 17*a* is connected to center shaft 15, which is journaled in bearings 25 as shown in FIG. 3B. Arm piece 17*b* is connected to center shaft 23. Arm piece 17*a* pivots about center shaft 15 of octagonal roll 16, and also pivots about link 19. Arm piece 17*b* is connected to and pivots about driven sprocket 24, and also pivots about link 19. The rotation of the driven sprocket pivots arm 17*b* about link 19, and hence pivots arm 17*a* about 19, thereby moving octagonal roll 16 along the surface of the batt.

The Rolator of the present invention further comprises an A-frame 32, which provides support for a hoist assembly. The hoist assembly enables the arm connected to the octagonal roll to be lifted up, so that the batt can be changed. As can be seen from FIG. 3, the hoist assembly comprises a hook 34 and a roller 36. The hoist assembly is motorized for ease of operation, and includes a motor 38 and a beam 40 which holds the motor.

In any of the embodiments discussed above, a batt is compressed to eliminate as much false loft and false support as possible so that it has an acceptable reduction in thickness and an acceptable load-at-half-height, when subjected to use for an average life cycle. Since false loft and false support are virtually eliminated, this thickness reduction and load-at-half-height are less than if no compression were applied. Thickness reduction is defined as the amount the thickness of the batt is reduced after an average life cycle, as compared to when the batt is new. Load-at-half-height is the force (lbs or kg) required to compress a batt to half of its original thickness, which represents the support level of the batt. The higher the value of load-at-half-height, the more support the batt has. An average life cycle for a batt used for a mattress, a seat cushion or a ground pad for a sleeping bag is defined as six years of use by an "average person", beyond which point the performance of the mattress starts becoming unacceptable. For purposes of the present invention, in order to quantify "average person", an average life cycle is simulated by 40,000 cycles of Rolator compression, using a 320 lb octagonal roll.

In accordance with the present invention, a batt is produced which is compressed before it is used so that, after an average life cycle, it has a thickness reduction of less than 15% and a reduction in load-at-half-height of less than 40%. This reduction in thickness and load-at-half-height are deemed acceptable, in that, after relatively few compression cycles (five cycles according to the first two embodiments of FIGS. 1 and 2, respectively, or twenty cycles according to the third embodiment of FIGS. 3 and 3A), most of the false loft and false support of the batt is removed. The significance of these values for thickness reduction and load-at-half-height will be illustrated by the following Examples.

TEST METHODS

Figure 4:
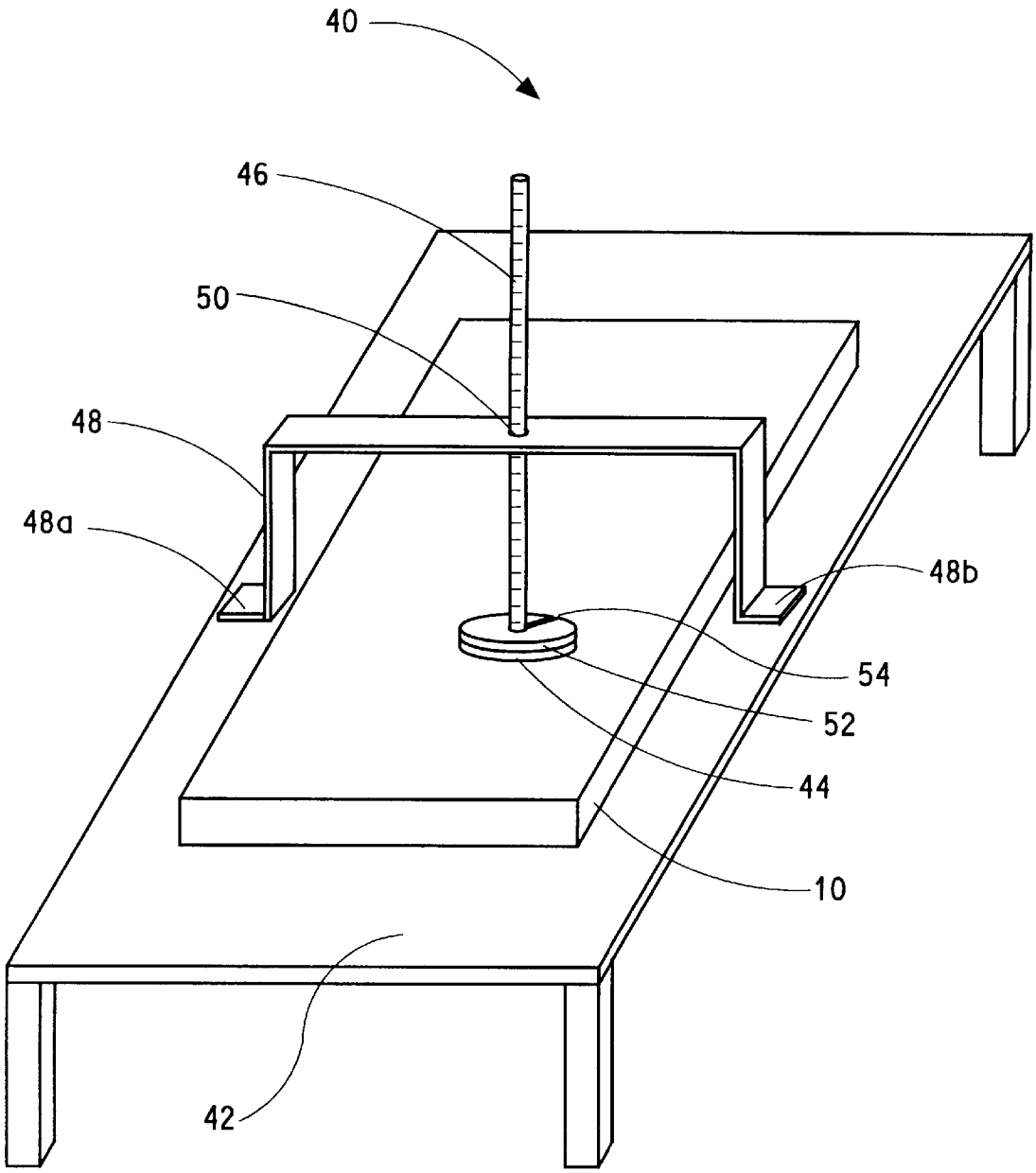
FIG. 4 is a perspective view of a device used for measuring thickness and load-at-half-height according to the present invention.

The test methods used in the following Examples are described below. Thickness and load were measured on a device shown generally at 40 in FIG. 4. These measurements were then used to calculate thickness reduction and load-at-half-height as described below. Referring to FIG. 4, device 40 includes a bench 42, on top of which the batt is placed. The device also includes a round metal base 44, measuring 8" (20 cm) in diameter, which is connected to a metal rod scale 46. The round base rests on top of the batt. The device further includes a supporting frame 48 having a pair of legs 48*a*, 48*b*, resting on the bench top. The metal scale is held in place by a small hole 50 formed in the frame. The scale is calibrated when the base, but not the batt, rests on the bench top. The metal base is then raised, and the batt is put on the bench top and under the supporting frame. The metal base is then placed on top of the batt, and the initial thickness is read from the scale. Thickness reduction is obtained by subtracting the thickness of the batt after the average life cycle has been simulated from the thickness of the batt before the average life cycle has been simulated.

Figure 5:
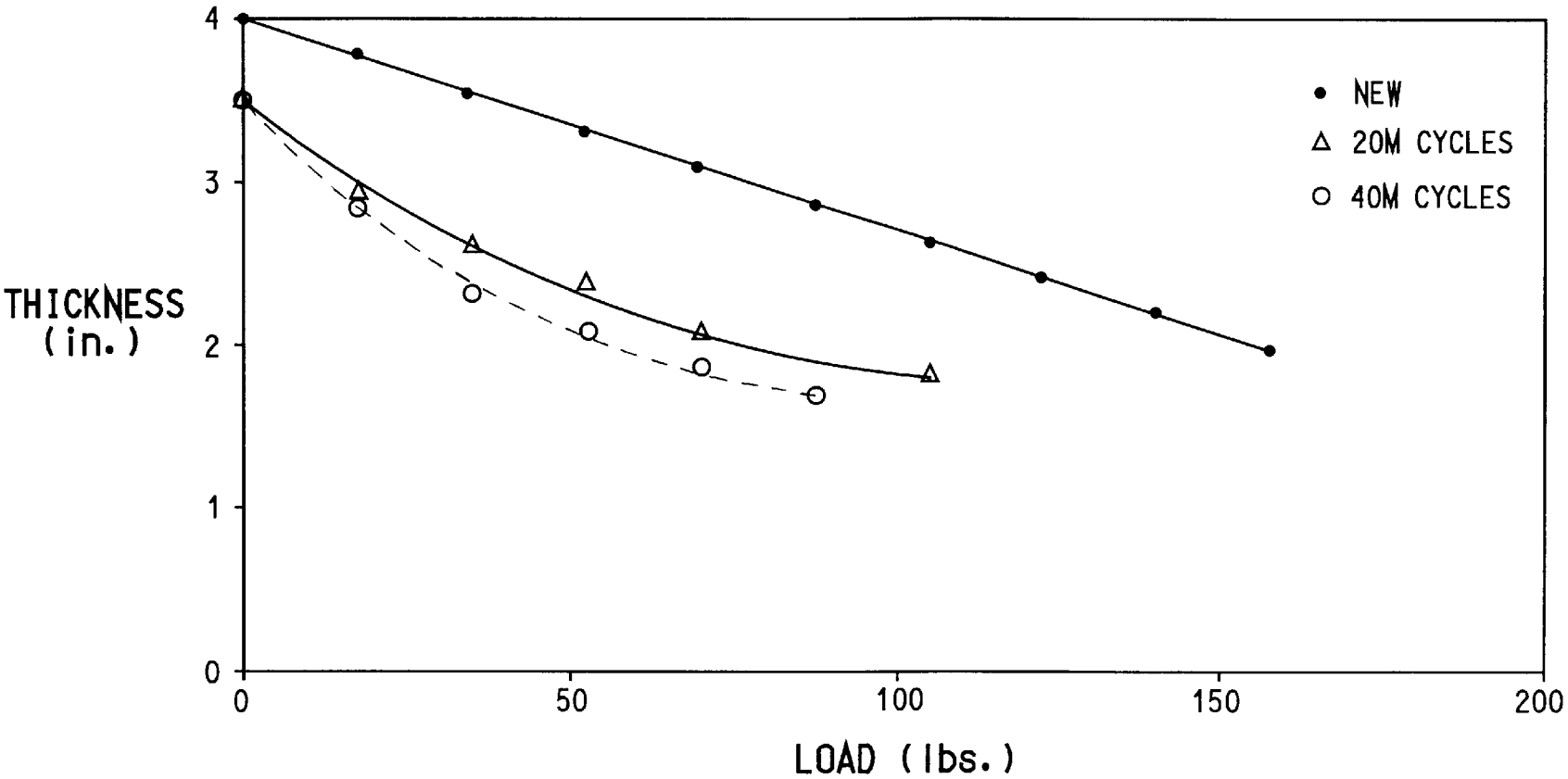
FIG. 5 are stress-strain curves for a new batt subjected to five compressions according to the present invention, and for the same batt after 20,000 cycles and after 40,000 cycles of simulated use.

After the initial thickness is read and recorded, the same device is then used to determine load, and thus, load-at-half-height. A weight 52, in this case, a 17 lb (7.7 kg) weight, 8" (20 cm) in diameter, having an open slit 54 to allow scale 46 to pass therethrough, is placed on top of the round metal base. The batt is compressed by this weight, and the thickness of the batt is reduced, as indicated on the scale. After the thickness is read and recorded, another weight, in this case, a weight 8" (20 cm) in diameter, 17 lb (7.7 kg) weight is placed on top of the previous weight, which is already resting on the round metal base. Once again, the batt is compressed further, and the thickness of the batt is reduced further. The thickness and the total weight (i.e., the weight of the first and second 17 lb weights) is read and recorded. The process is repeated with a third and a fourth weight, etc. identical to the first and second weights in diameter and weight, until the thickness is reduced to half of the batt's original thickness. The total weight used to reduce the thickness to half of the original thickness is defined as load-at-half-height. If the last weight put on the round metal base reduces the thickness more than half of the original thickness, calculation is carried out to determine the load-at-half-height from a weight vs. thickness plot, as illustrated in FIG. 5. This weight vs. thickness plot is referred to hereinafter as a stress-strain curve, although the plots used herein graph the force per unit area vs. thickness change (not elongation) per unit area. Three locations of the batts are measured, i.e., the center, and then a location up vertically from the center in FIG. 4 and a location down vertically from the center in FIG. 4. The average of these three results is reported as the load-at-half-height in the tables in the Examples below.

EXAMPLE 1

Polyester staple fiber comprising a spin blend (i.e., a mixture of fibers exiting a spinneret) of 50%, 15 denier (17 dtex), 4-hole round, and 50%, 15 denier (17 dtex), solid trilobal cross-section, having a cut length of 3" (76 mm), was blended with Melty 4080, 4 denier (4.5 dtex), 2.5" (64 mm) sheath/core binder fiber. Specifically, 75 parts of the polyester staple fiber were blended with 25 parts of the Melty. This blend was processed on a VFT (vertical folding technology) line to make VFT batts which had a density of 1.7 lb/ft$^3$ density (27 kg/m$^3$). The batts were heated to activate the Melty 4080 at a 200° C. oven set temperature. Four 72"×36"×4" (183 cm×91 cm×10 cm) single mattress size VFT batts were made. These batts were treated as follows:

Sample A. Control, no compression

Sample B. Compressed 1 time through a pair of cold calender rolls with a clearance at 1.5" (38 mm) (below the half-height of the 4" thick (102 mm) VFT batt Sample C. Compressed 5 times through the pair of cold calender rolls with the same clearance as in Sample B Sample D. Compressed 10 times through the cold calender rolls with the same clearance as in Sample B The thicknesses of the batts were measured. The thickness measurements are given in Table 1 under the headings "New", with metric equivalents being given in parentheses. Stress-strain curves were also plotted as shown in FIG. 5 for Sample C. by measuring the thickness reduction vs. weights put on a round 8 inch (20 cm) diameter, 50.3 in$^2$ (325 cm$^2$) area, metal foot resting on the surface of the batt as described above with respect to FIG. 4. From these stress-strain curves, the loads-at-half-height were determined. After completion of these measurements, the batts were subjected to a Rolator, which was rolled repeatedly across the width of the VFT batt, back and forth, for 20,000 (20M) cycles. Each of the four VFT batts was then measured for load-at-half-height and thickness. After these measurements, the batts were subjected to another 20,000 cycles of rolling, for a total of 40,000 (40M) cycles. Again, the load-at-half-height and thickness were measured. The results are listed in Table 1. Percentage reductions in load-at-half-height and thickness were calculated based on the differences between the thickness of the batt when new (i.e., compressed according to the present invention, but not yet subjected to an average life cycle) and after an average life cycle (i.e., 40M cycles).

TABLE 1

| | | Load-at-half-height (lbs) | | | | Thickness (inches) | | | |
|---|---|---|---|---|---|---|---|---|---|
| Sample | Density (lb/ft$^3$) | New | 20M | 40M | % Reduction | New | 20M | 40M | % Reduction |
| A | 1.69 (27 kg/m$^3$) | 211 (91 kg) | 118 (54 kg) | 100 (45 kg) | 53 | 4.4 (11.2 cm) | 3.8 (9.7 cm) | 3.5 (8.9 cm) | 20 |
| B | 1.75 (28 kg/m$^3$) | 192 (87 kg) | 120 (55 kg) | 113 (51 kg) | 41 | 4.2 (10.7 cm) | 3.7 (9.4 cm) | 3.5 (8.9 cm) | 17 |
| C | 1.68 (27 kg/m$^3$) | 158 (72 kg) | 105 (48 kg) | 105 (46 kg) | 34 | 4.0 (10.2 cm) | 3.6 (9.1 cm) | 3.5 (8.9 cm) | 12 |
| D | 1.73 (26 kg/m$^3$) | 158 (72 kg) | 110 (50 kg) | 105 (48 kg) | 34 | 4.0 (10.2 cm) | 3.5 (8.9 cm) | 3.5 (8.9 cm) | 12 |

This Example shows that even after one compression, the reduction in load-at-half-height and thickness are less, and therefore, more durable for consumer use. With five compressions or more, the improvement is even more significant.

EXAMPLE 2

The same fibers as in Example 1 were used to make batts with various densities as shown in Table 2. However, in this Example, the temperature used to active the Melty was 220° C., instead of 200° C. Each batt was measured for load-at-half-height and thickness. The batts were then compressed by a Rolator for 20 cycles, and measured for load-at-half-height and thickness. The batts were then compressed for a total of 40,000 cycles by the Rolator, with load-at-half-height and thickness being measured after each compression of 20M and 40M cycles, respectively.

Percent reduction in load-at-half-height and thickness were calculated based on the differences between new and after 40M cycles and between after 20 cycles and 40M cycles. The results are listed in Table 2.

TABLE 2

| Sample | Density (lb/ft$^3$) | New | 20 cycles | 20M | 40M | % Reduction (from new) | Reduction (from 20 cycles) |
|---|---|---|---|---|---|---|---|
| A) Load-at-half-height (lbs) | | | | | | | |
| E | 1.6 (26 kg/m$^3$) | 200 (91 kg) | 195 (89 kg) | 110 (50 kg) | 110 (50 kg) | 45 | 44 |
| F | 1.8 (29 kg/m$^3$) | 230 (105 kg) | 230 (105 kg) | 160 (73 kg) | 140 (64 kg) | 39 | 39 |

TABLE 2-continued

| Sample | Density (lb/ft$^3$) | New | 20 cycles | 20M | 40M | % Reduction (from new) | Reduction (from 20 cycles) |
|---|---|---|---|---|---|---|---|
| G | 2.0 | 310 | 290 | 230 | 210 | 32 | 28 |
| | (32 kg/m$^3$) | (141 kg) | (132 kg) | (105 kg) | (95 kg) | | |
| B Thickness (inches) | | | | | | | |
| E | 1.6 | 4.1 | 3.9 | 3.5 | 3.3 | 19.5 | 15 |
| | (26 kg/m$^3$) | (10.4 cm) | (9.9 cm) | (8.9 cm) | (8.4 cm) | | |
| F | 1.8 | 4.1 | 3.9 | 3.6 | 3.5 | 14.6 | 10 |
| | (29 kg/m$^3$) | (10.4 cm) | (9.9 cm) | (9.1 cm) | (8.9 cm) | | |
| G | 2.0 | 4.5 | 4.3 | 4.2 | 4.1 | 8 | 5 |
| | (32 kg/m$^3$) | (11.4 cm) | (10.9 cm) | (10.7 cm) | (10.4 cm) | | |

As the results in this Example illustrate, samples E, F and G maintained better support (less reduction of load-at-half-height) and thickness (less reduction in thickness) after 20 cycles of compression by a Rolator.

The 20 cycles is only 0.05% of the total 40M cycles normally used for the test for an average life cycle, which simulates six years of use. Therefore, a Rolator is another effective way to compress a batt to reduce the changes in thickness and load-at-half-height during use, and extend the useful life of the batt.

EXAMPLE 3

The same fibers as in Example 1 were used to make about 1.7 lb/ft$^3$ (27 kg/m$^3$) density batt, but in this Example various bonding temperatures were used. Oven temperatures were set at 180° C., 200° C., 220° C. and 240° C., respectively, for four samples. Each batt was compressed by a Rolator as described with respect to FIG. 3. The results are listed in Table 3.

As the results for this Example illustrate, all the batts with various bonding temperatures benefited from 20 cycle compression by a Rolator. The reductions in load-at-half-height and thickness were significantly minimized.

EXAMPLE 4

The same fibers as described in Example 1 were used in this Example, but the ratios of the polyester staple fiber and the binder fiber were changed. The oven temperature was set at 220° C. The batt density was maintained at 1.8 lb/ft$^3$ (29 kg/m$^3$). The batts were compressed by a Rolator for 20 cycles. The test results are listed in Table 4.

TABLE 3

| Sample | Density (lb/ft$^3$) | New | 20 cycles | 20M | 40M | % Reduction (from new) | Reduction (from 20 cycles) |
|---|---|---|---|---|---|---|---|
| A) Load-at-half-height (lbs) | | | | | | | |
| M | 1.89 | 184 | 158 | 92 | 60 | 60 | 53 |
| | (26 kg/m$^3$) | (84 kg) | (72 kg) | (42 kg) | (27 kg) | | |
| I | 1.63 | 210 | 190 | 118 | 114 | 44 | 40 |
| | (26 kg/m$^3$) | (95 kg) | (86 kg) | (54 kg) | (52 kg) | | |
| J | 1.87 | 230 | 230 | 160 | 140 | 39 | 39 |
| | (30 kg/m$^3$) | (105 kg) | (105 kg) | (73 kg) | (64 kg) | | |
| K | 1.71 | 255 | 230 | 184 | 140 | 45 | 39 |
| | (27 kg/m$^3$) | (116 kg) | (105 kg) | (84 kg) | (64 kg) | | |
| B) Thickness (inches) | | | | | | | |
| H | 1.59 | 4.6 | 4.4 | 3.9 | 3.7 | 20 | 16 |
| | (26 kg/m$^3$) | (11.7 cm) | (11.2 cm) | (9.9 cm) | (9.4 cm) | | |
| I | 1.63 | 4.5 | 4.2 | 3.7 | 3.6 | 20 | 14 |
| | (26 kg/m$^3$) | (11.4 cm) | (10.7 cm) | (9.4 cm) | (9.1 cm) | | |
| J | 1.87 | 4.1 | 3.9 | 3.6 | 3.5 | 14.6 | 10 |
| | (30 kg/m$^3$) | (10.4 cm) | (9.9 cm) | (9.1 cm) | (8.9 cm) | | |
| K | 1.71 | 4.1 | 3.6 | 3.5 | 3.4 | 17 | 6 |
| | (27 kg/m$^3$) | (10.4 cm) | (9.1 cm) | (8.9 cm) | (8.6 cm) | | |

TABLE 4

| Sample | Binder Fiber % | Density (lb/ft$^3$) | New | 20 cycles | 20M | 40M | % Reduction (from new) | Reduction (from 20 cycles) |
|---|---|---|---|---|---|---|---|---|
| A) Load-at-half-height (lbs) | | | | | | | | |
| L | 20 | 1.75 (28 kg/m$^3$) | 180 (82 kg) | 175 (80 kg) | 105 (48 kg) | 87 (40 kg) | 52 | 50 |
| M | 25 | 1.87 (30 kg/m$^3$) | 230 (105 kg) | 230 (105 kg) | 160 (73 kg) | 140 (64 kg) | 39 | 39 |
| N | 30 | 1.71 (27 kg/m$^3$) | 260 (118 kg) | 230 (105 kg) | 200 (91 kg) | 175 (80 kg) | 33 | 24 |
| B) Thickness (inches) | | | | | | | | |
| L | 20 | 1.75 (28 kg/m$^3$) | 4.2 (10.7 cm) | 4.0 (10.2 cm) | 3.6 (9.1) | 3.4 (8.6 cm) | 19 | 15 |
| M | 25 | 1.87 (30 kg/m$^3$) | 4.1 (10.4 cm) | 3.9 (9.9 cm) | 3.6 (9.1) | 3.5 (8.9) | 14.6 | 10 |
| N | 30 | 1.71 (27 kg/m$^3$) | 4.3 (10.9 cm) | 4.0 (10.2 cm) | 3.7 (9.4) | 3.6 (9.1 cm) | 16 | 10 |

The results of Example 4 show that batts with various levels of binder fiber all benefit from compression with Rolator. The percentage reduction in load-at-half-height and thickness were significantly minimized.

EXAMPLE 5

The same polyester staple fiber used in Examples 1–4 was blended with Melty 7080, a 4 denier sheath/core (4.5 detex) binder fiber having a higher melting point than the binder fiber used in Examples 1–4 (Melty 4080). The blend ratio was the same as in Example 1 (i.e., 75% polyester staple fiber and 25% binder fiber were blended). Batts were made as described in Example 1, but the oven temperature was set at 240° C. The batts were compressed by a Rolator for 20 cycles. The results are listed in Table 5.

As can be seen from Table 5, when Melty 7080 binder fiber is used, the batts have a similar response as when Melty 4080 binder fiber is used. The Rolator compression for 20 cycles significantly improves the durability of the batts.

EXAMPLE 6

The same fibers as in Example 5 were used in this Example, except that the ratio of polyester staple fiber to binder fiber (Melty 7080) was 70/30. Batts were made as in Example 1. These batts were compressed 20 cycles by a Rolator as in Examples 2–5. The results are listed in Table 6.

TABLE 5

| Sample | Density (lb/ft$^3$) | New | 20 cycles | 20M | 40M | % Reduction (from new) | Reduction (from 20 cycles) |
|---|---|---|---|---|---|---|---|
| A) Load-at-half-height (lbs) | | | | | | | |
| O | 1.91 (31 kg/m$^3$) | 296 (135 kg) | 261 (119 kg) | 211 (96 kg) | 193 (88 kg) | 35 | 26 |
| P | 1.91 (31 kg/m$^3$) | 287 (130 kg) | 250 (114 kg) | 210 (95 kg) | 188 (85 kg) | 34 | 25 |
| Q | 1.94 (31 kg/m$^3$) | 287 (130 kg) | 280 (127 kg) | 260 (118 kg) | 230 (105 kg) | 20 | 18 |
| B) Thickness (inches) | | | | | | | |
| O | 1.91 (31 kg/m$^3$) | 4.3 (10.9 cm) | 4.1 (10.4) | 4.0 (10.2) | 3.8 (9.7) | 12 | 7 |
| P | 1.91 (31 kg/m$^3$) | 4.2 (10.7 cm) | 4.0 (10.2) | 3.8 (9.7) | 3.7 (9.4) | 13 | 8 |
| Q | 1.94 (31 kg/m$^3$) | 4.3 (10.9 cm) | 4.0 (10.2) | 3.9 (9.9) | 3.8 (9.7) | 11 | 5 |

TABLE 6

| Sample | Density (lb/ft$^3$) | New | 20 cycles | 20M | 40M | % Reduction (from new) | Reduction (from 20 cycles) |
|---|---|---|---|---|---|---|---|
| A) Load-at-half-height (lbs) | | | | | | | |
| R | 1.68 (27 kg/m$^3$) | 250 (114 kg) | 207 (94 kg) | 193 (88 kg) | 172 (78 kg) | 31 | 17 |
| S | 1.98 (32 kg/m$^3$) | 305 (139 kg) | 270 (123 kg) | 235 (107 kg) | 220 (100 kg) | 28 | 19 |
| T | 2.13 (34 kg/m$^3$) | 425 (193 kg) | 360 (164 kg) | 340 (155 kg) | 320 (145 kg) | 25 | 11 |
| B) Thickness (inches) | | | | | | | |
| R | 1.68 (27 kg/m$^3$) | 4.4 (11.2 cm) | 4.1 (10.4) | 4.0 (10.2) | 3.9 (9.9) | 11 | 5 |
| S | 1.98 (32 kg/m$^3$) | 4.1 (10.4 cm) | 3.8 (9.6) | 3.8 (9.6) | 3.7 (9.4) | 9 | 3 |
| T | 2.13 (34 kg/m$^3$) | 4.2 (10.7 cm) | 4.1 (10.4) | 4.0 (10.2) | 4.0 (10.2) | 5 | 2 |

As can be seen from this Example, batts made of Melty 7080 with a ratio of polyester staple fiber to binder fiber of 70/30 can benefit from 20 cycles of Rolator compression. After 20 cycles of Rolator compression, the batts' durability was significantly improved by reducing false loft and false support.

EXAMPLE 7

Conjugate polyester staple fiber 15 denier (17 dtex), having a cut length of 3" (76 mm) was used in this Example instead of the base fiber as described in Example 1, with the same binder fiber as described in Example 1. Batts were made, and the results are listed in Table 7.

TABLE 7

| Sample | Density (lb/ft$^3$) | New | 20 cycles | 20M | 40M | % Reduction (from new) | Reduction (from 20 cycles) |
|---|---|---|---|---|---|---|---|
| A) Load-at-half-height (lbs) | | | | | | | |
| U | 1.67 (27 kg/m$^3$) | 212 (96 kg) | 207 (94 kg) | 125 (57 kg) | 105 (48 kg) | 50 | 49 |
| V | 1.91 (31 kg/m$^3$) | 274 (125 kg) | 260 (118 kg) | 193 (88 kg) | 158 (72 kg) | 42 | 39 |
| W | 2.12 (34 kg/m$^3$) | 310 (141 kg) | 270 (123 kg) | 265 (121 kg) | 193 (74 kg) | 38 | 29 |
| B) Thickness (inches) | | | | | | | |
| U | 1.67 (27 kg/m$^3$) | 4.3 (10.9 cm) | 4.0 (10.2 cm) | 3.7 (9.4 cm) | 3.6 (9.1 cm) | 16 | 11 |
| V | 1.91 (31 kg/m$^3$) | 4.3 (10.9 cm) | 4.1 (10.4 cm) | 4.0 (10.2 cm) | 3.7 (9.4 cm) | 15 | 10 |
| W | 2.12 (34 kg/m$^3$) | 4.3 (10.9 cm) | 4.1 (10.4 cm) | 4.0 (10.2 cm) | 3.8 (9.7 cm) | 12 | 7 |

As can be seen from Table 7, 20-cycle Rolator compression also benefits batts using conjugate fibers as supporting fibers. Specifically, the durability of the batts is improved with compression.

What is claimed is:

1. A batt which is formed from fiber and then compressed, so that the compressed batt, when subjected to use for an average life cycle, has a thickness reduction of less than 15% and a reduction of load-at-half-height of less than 40%.

2. The batt of claim 1, wherein the batt is used in a mattress, a seat cushion or a grounding pad for a sleeping bag, and the average life of the batt is six years.

3. A process for making a compressed batt, comprising:

forming a batt from a fiber; and compressing the batt with a compression device, so that the compressed batt, when subjected to use for an average life cycle, has a thickness reduction of less than 15% and a reduction of load-at-half-height of less than 40%.

4. The process of claim 3, wherein the compression device comprises at least one pair of rolls, and the batt is compressed between the rolls at least five times.

5. The process of claim 3, wherein the clearance between the rolls is adjusted to less than half of the thickness of the batt.

6. The process of claim 4, wherein the compression device comprises a plurality of pairs of rolls, and the batt is fed sequentially through each pair of rolls.

7. The process of claim 3, wherein the compression device comprises an octagonal roll which applies a force of at least 320 pounds for at least 20 cycles.

* * * * *